US007651242B1

(12) United States Patent
Guerrant

(10) Patent No.: US 7,651,242 B1
(45) Date of Patent: Jan. 26, 2010

(54) VEHICLE WARNING LAMP

(76) Inventor: George H. Guerrant, 51631 Clubhouse Dr., South Bend, IN (US) 46628

( * ) Notice: Subject to any disclaimer, the term of this patent is extended or adjusted under 35 U.S.C. 154(b) by 0 days.

(21) Appl. No.: 12/249,375

(22) Filed: Oct. 10, 2008

(51) Int. Cl.
*F21S 8/10* (2006.01)

(52) U.S. Cl. ..... 362/286; 362/131; 362/275; 362/526

(58) Field of Classification Search ..... 362/249.03, 362/258, 286, 386, 387, 523, 526, 540, 131, 362/269, 275, 287, 427, 458; 116/173
See application file for complete search history.

(56) References Cited

U.S. PATENT DOCUMENTS 4,178,625 A 12/1979 Schudel
4,802,069 A * 1/1989 Chandler ..... 362/526
4,856,452 A 8/1989 Pingel et al.
4,870,543 A 9/1989 Born et al.
5,065,299 A 11/1991 Cohen
5,791,761 A 8/1998 Bryant et al.
6,215,553 B1 4/2001 Rider et al.
7,572,024 B2 * 8/2009 Ko et al. ..... 362/287
2007/0283875 A1 * 12/2007 Durkin ..... 116/173

FOREIGN PATENT DOCUMENTS

JP 63173743 A * 7/1988

* cited by examiner

*Primary Examiner*—Y My Quach Lee
(74) *Attorney, Agent, or Firm*—Botkin & Hall, LLP

(57) ABSTRACT

A wheelchair lamp that is primarily for making a wheelchair more visible. The wheelchair lamp includes a housing that is mounted to the wheelchair. An extendable member having a light on top extends from the housing. The extendable member may be extended and retracted. A motor is contained within the housing to extend and retract the extendable member. An electrical conductor is longitudinally disposed with the extendable member. The electrical conductor electrically connects the light and the power source. A switch is used to selectively connect the motor to the power source causing the motor to operate so that the motor may extend or retract the extendable member. The light is extended and lit when a wheelchair user is near traffic or potentially at risk for a collision and is typically retracted when the user is indoors.

12 Claims, 5 Drawing Sheets

FIG.4
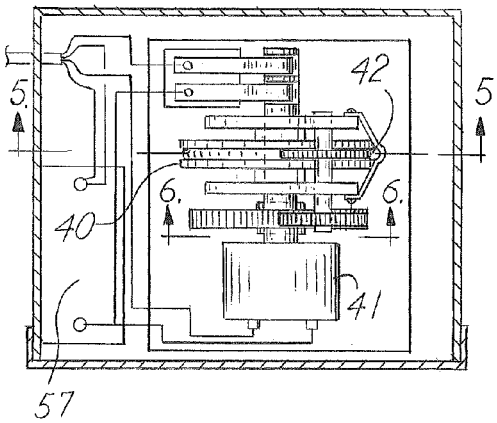
FIG.5
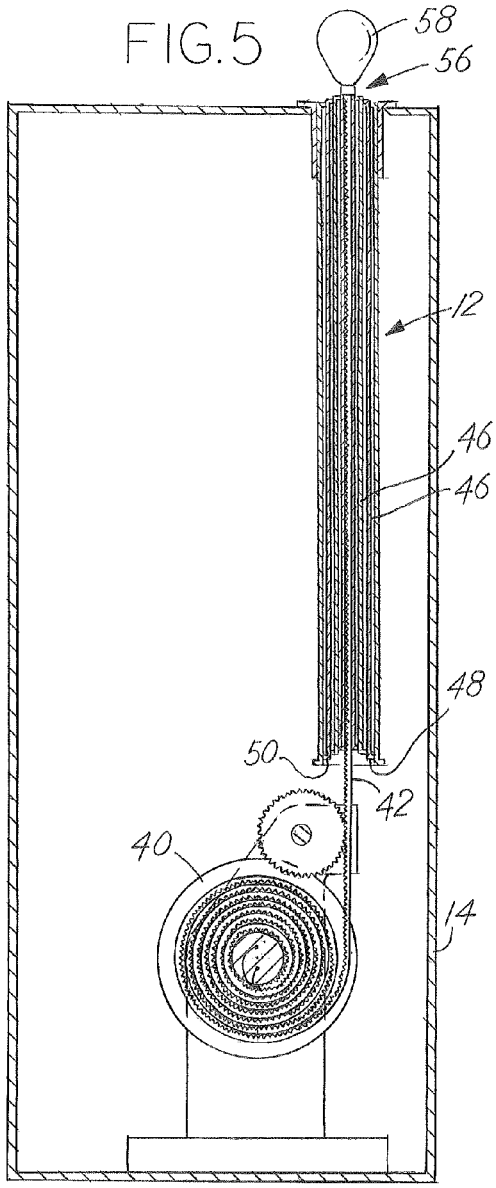
FIG.6
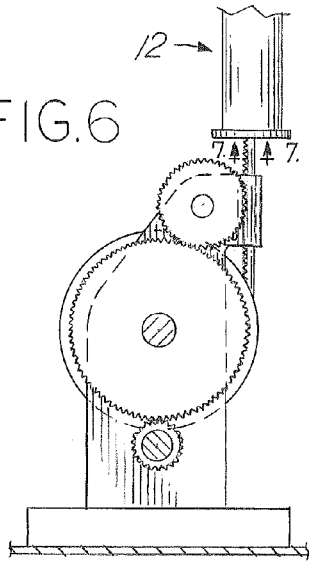
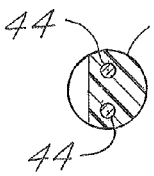
FIG.7

VEHICLE WARNING LAMP

BACKGROUND OF THE INVENTION

Making wheelchairs and other small vehicles highly visible is important to prevent accidents with motor vehicles. In particular, many wheelchair users have been struck by cars when crossing streets because motorists failed to see them. Wheelchair users have employed tactics such as attaching flags, or wearing reflective clothing to make themselves more visible. Objects such as flags may make some marginal improvement in visibility over a plain wheelchair, but do not make a bold enough impression so that a motorist approaching a wheelchair will notice in time to make a complete stop or avoid a collision. Another drawback to flags is the lack of visibility at night. Even the most highly reflective flag may not provide enough notice to a motorist that he is approaching a wheelchair.

An answer to the problem of visibility at night and visibility in general is to add a light to a wheelchair. This has been done in U.S. Pat. No. 5,791,761 ('761 patent). However, even with the addition of a light, there still remains the problem of having a large distracting object protruding from the back of a wheelchair. As much as a wheelchair user wishes to be noticed when he is near traffic, he might not want to have a large light or flag prominently displayed above his head at all times when indoors. The wheelchair user may draw unwanted attention to himself, and thus the invention of the '761 patent does not present the best solution.

SUMMARY OF THE INVENTION

The present invention is a vehicle wanting lamp that is primarily for making a vehicle, such as a wheelchair, more visible when crossing a street or when near traffic, especially when ambient light is insufficient. The vehicle warning lamp includes a housing that is mounted to the wheelchair or other small vehicle. An extendable member extends from the housing, and the extendable member has a first retracted position and a second extended position. The extendable member is movable between the first and second position. A motor is contained within the housing, and the motor is connected to the extendable member for moving the extendable member between the first retracted position and the second extended position. A light is mounted near a distal end of the extendable member. An electrical conductor is longitudinally disposed with the extendable member. The electrical conductor electrically connects the light and the power source. A switch is used to selectively connect the motor to the power source causing the motor to operate so that the motor may extend or retract the extendable member.

An object of the invention is to make a wheelchair or other vehicle more visible when it is near traffic.

Other objects of the invention will become apparent upon reading the detailed description of the invention.

BRIEF DESCRIPTION OF THE DRAWINGS

FIG. 4 is a sectional view of the vehicle warning lamp as viewed from the top down;

FIG. 5 is a sectional view taken about the line 5-5 in FIG. 4;

FIG. 6 is a sectional view taken about the line 6-6 in FIG. 4;

FIG. 7 is a sectional view taken about the line 7-7 in FIG. 6; and

DETAILED DESCRIPTION OF INVENTION

Figure 1:
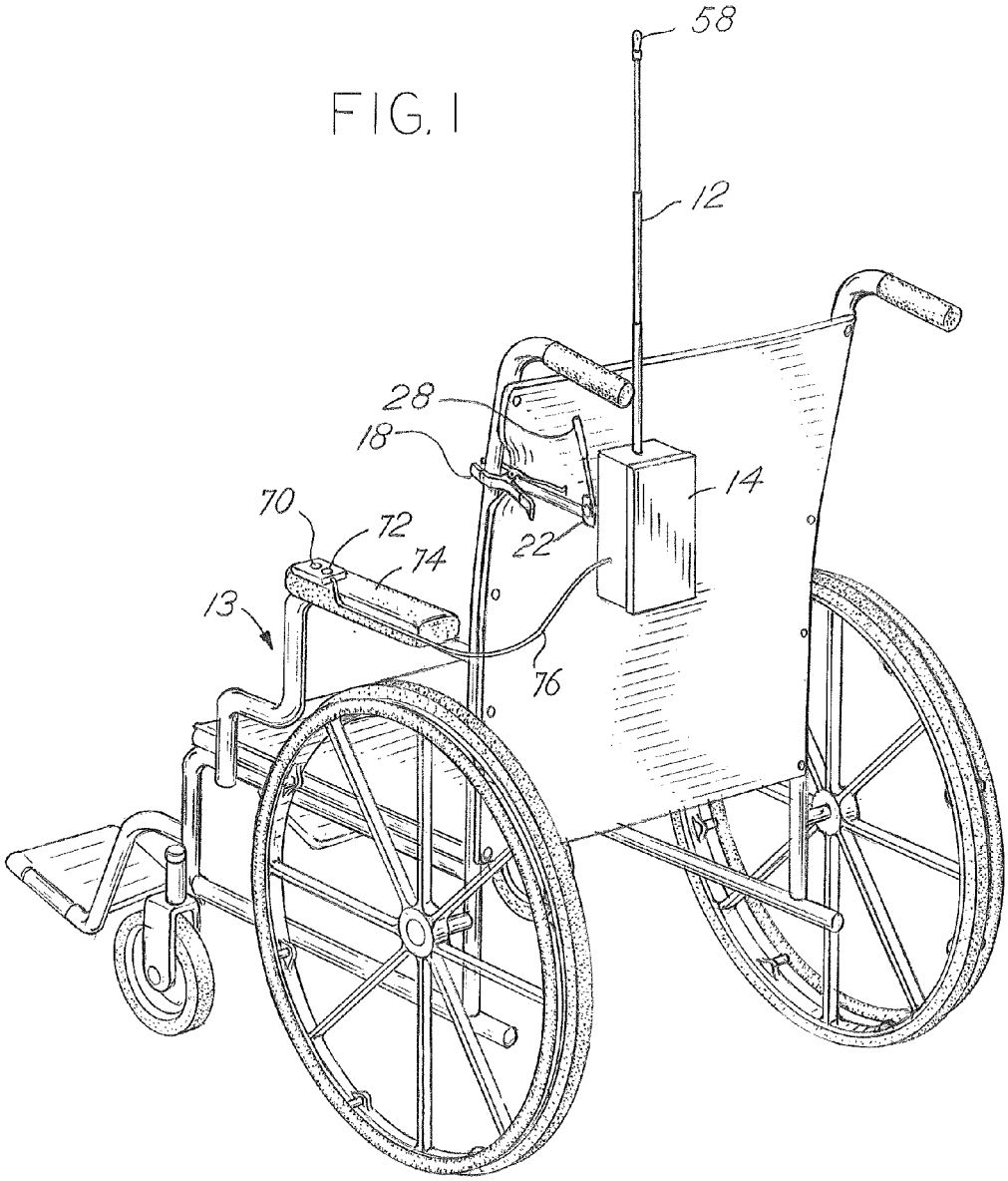
FIG. 1 is a perspective view of a wheelchair having the vehicle warning lamp attached.
Figure 2:
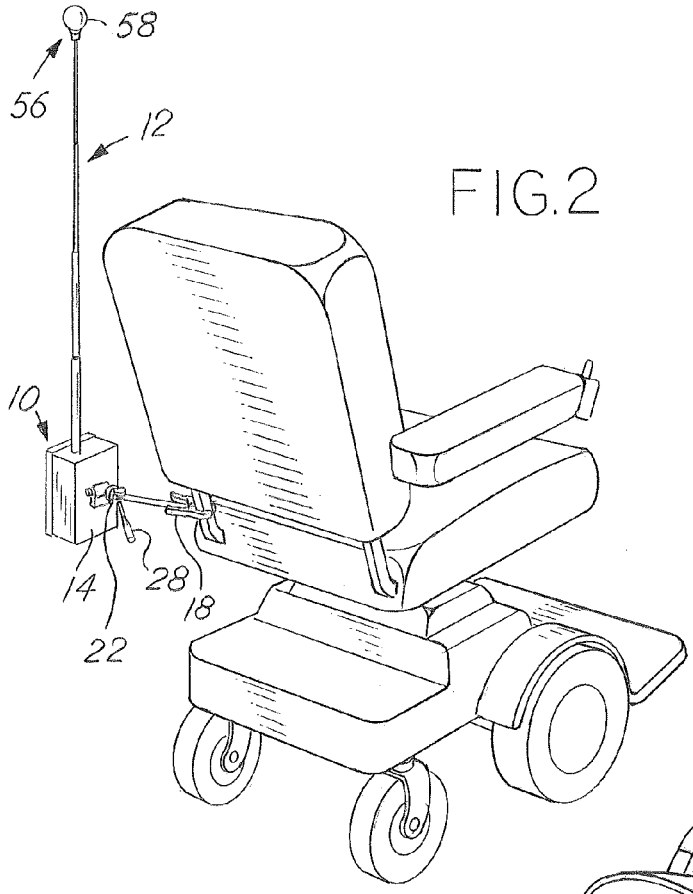
FIG. 2 is a perspective view of a motorized wheelchair having the vehicle warning lamp attached.
Figure 3:
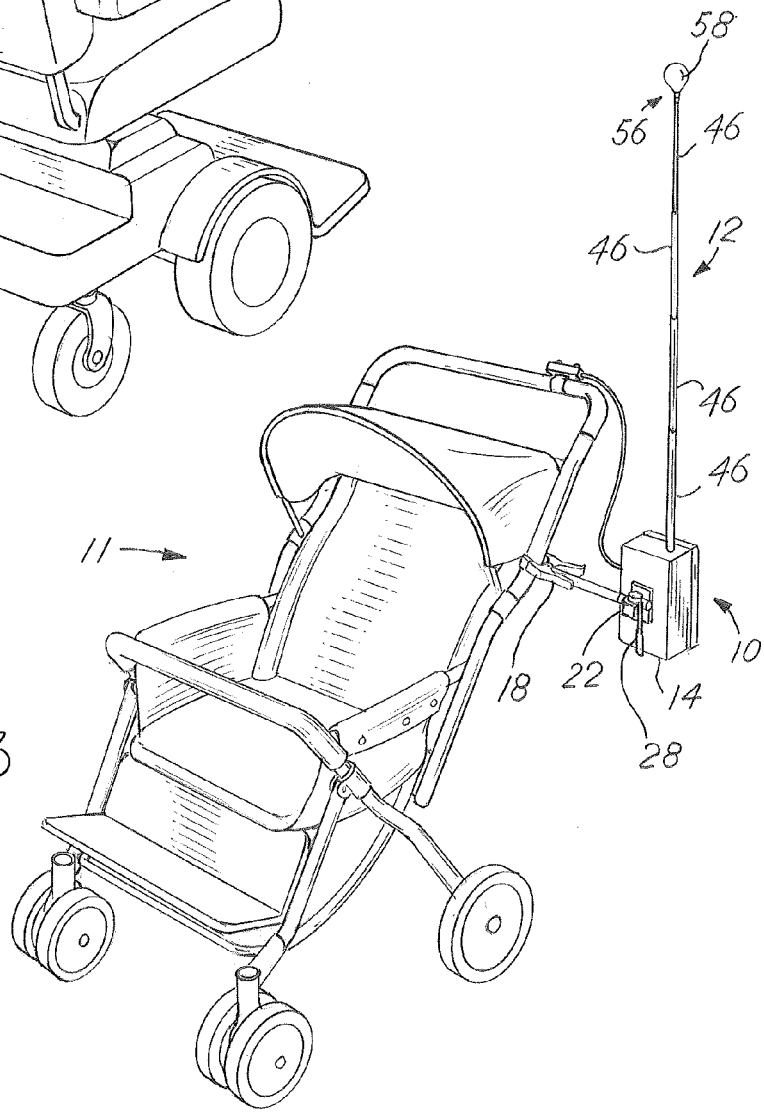
FIG. 3 is a perspective view of a stroller having the vehicle warning lamp attached.

The vehicle warning lamp 10 of this invention has an extendable member 12 that protrudes from a housing 14. FIG. 1 is a perspective view of the wheelchair lamp attached to a wheelchair 13. The warning lamp 10 is attached to a wheelchair 13 or other small vehicle such as a stroller 11 using a clamp 18 that is spring loaded. Although the warning lamp 10 may be used on many vehicles, the example of a wheelchair will be discussed extensively below. This is not intended to limit the use of the warning lamp 10 to wheelchairs 13. It is conceivable that one skilled in the art may employ other similar mounting means to the clamp 18 to accomplish mounting of the housing to a wheelchair 13, stroller 11, or other vehicle.

Figure 8:
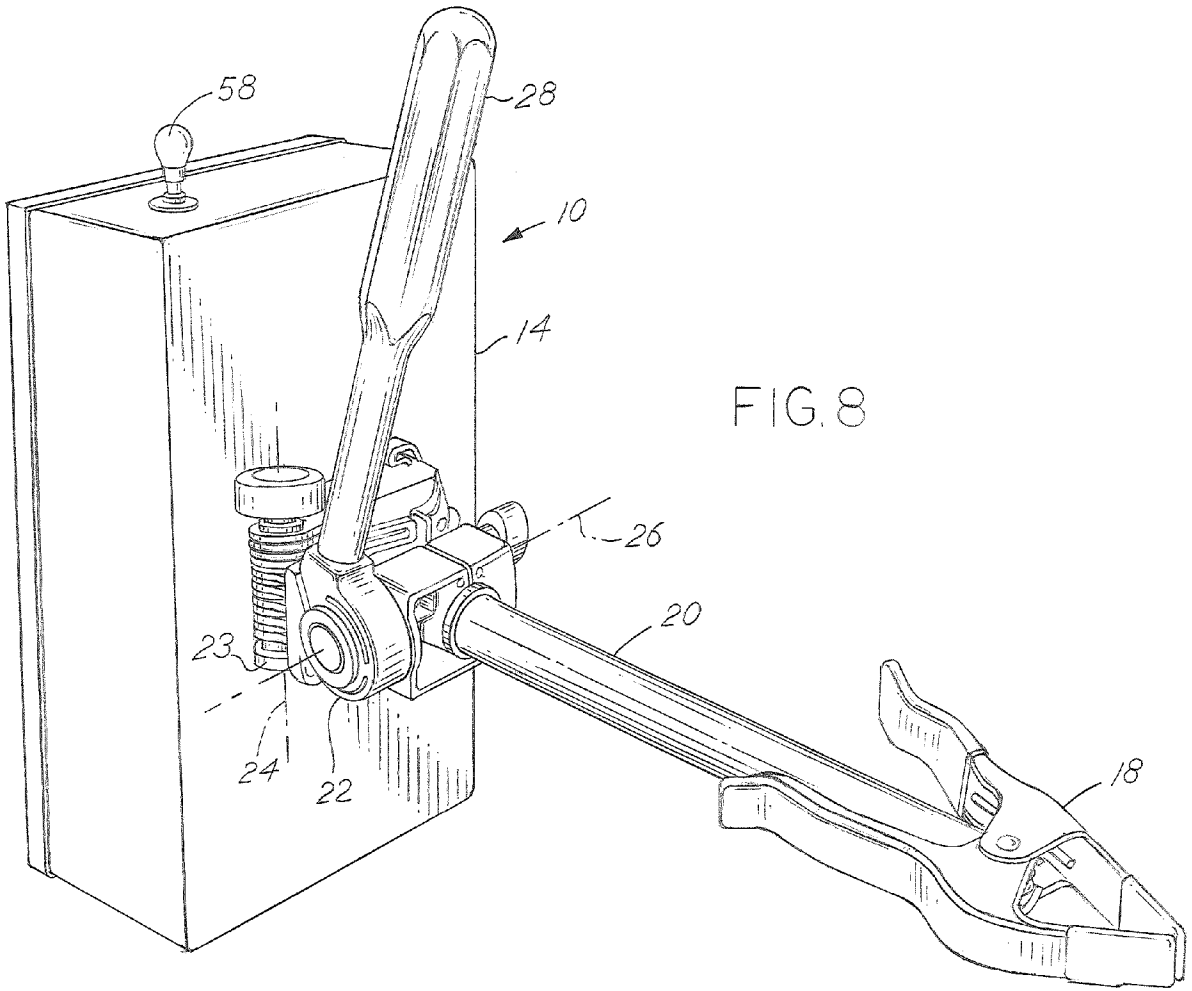
FIG. 8 is a perspective view of the vehicle warning lamp.

The clamp 18 is connected to a rod 20 which connects to a multi-axis swivel 22. The rod 20 is telescoping and may be adjusted to a desired length. FIG. 8 shows the multi-axis swivel 22 in detail. The multi-axis swivel 22 allows the housing 14 to be pivoted about three axes to any angle necessary to accommodate the vehicle to which the warning lamp 10 is attached. The multi-axis swivel includes a hinged portion 23 that pivots about a first axis 24. The swivel 22 pivots about a second axis 26 that is perpendicular to the rod 20. The third axis about which the swivel 22 may pivot is the axis of the rod 20. A handle 28 is attached to the swivel 22 so it may be easily moved.

FIGS. 4 and 5 show a sectional view of the housing 14. The housing 14 contains a reel 40 on which a flexible member 42 can be wound. A motor 41 drives the reel 40 and winds or unwinds the flexible member 42. The flexible member 42 may contain electrical conductors 44 that are embedded within the flexible member 42, which is typically made of a plastic material. The electrical conductors 44 are shown in FIG. 7, run the length of the flexible member 42, and are insulated from each other. As the motor 41 turns the reel 40, the flexible member 42 will extend or retract the extendable member 12. The extendable member is made of individual telescoping segments 46. The telescoping members 46 stack together as shown in FIG. 5. Each telescoping member has a successively smaller cross section going upward and an annular lip 48 that catches at an end 50 of the telescoping member below it. The flexible member 42 extends through the center of all the individual telescoping members 46, and the electrical conductors 44 connect to a light 58 on top of the extendable member 12 at its distal end 56. The light 58 may be an LED, incandescent bulb, or any other means of producing sufficient light to make the vehicle connected to the warning lamp 10 more visible. The light 58 may be a continuously illuminated light or can be a flashing strobe light to make the wheelchair 13 more visible. The light may also be red, yellow, blue, or any other color that will be highly visible.

The electrical conductors 44 exit from the reel 40 in such a way as to be electrically connected to a battery 57 that powers the light 58. The battery 57 may be contained in the housing as shown in FIG. 4, or if the warning lamp 10 is used on a motorized wheelchair, the light 58 may be powered from the same battery that powers the drive wheels of the wheelchair.

Figure 9:
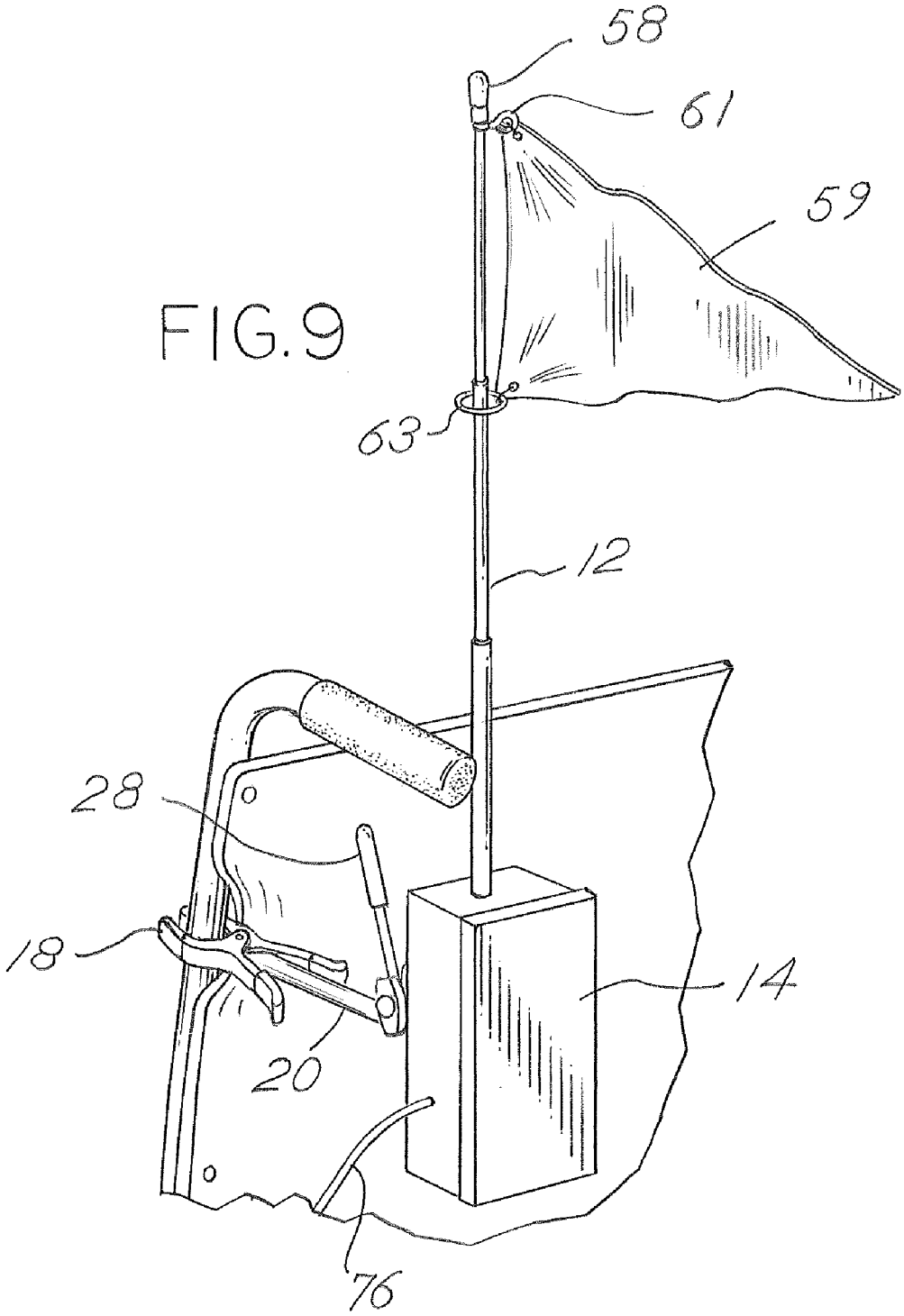
FIG. 9 is a view of the vehicle warning lamp including a flag attached to the extendable member.

In addition to the light 58 a flag 59 may be attached as a second signaling device near the distal end 56 of the extendable member 12. The flag 59 is made of a highly visible reflective material. FIG. 9 shows the flag 59 attached when the extendable member 42 is extended. The top of the flag 59 is attached to the extendable member 12 through a hook 61 that is secured to the extendable member 12 and moves with the distal end 56 of the extendable member 12. The bottom of the flag 59 is attached to a second ring 63 that slides along the extendable member 12. This method of attachment allows the flag 59 to be folded against the top of the housing 14 when the extendable member 12 is completely retracted and unfolded when the extendable member 12 is raised.

A light switch 70 and a motor switch 72 are located on an arm rest 74 of the wheelchair 13. This puts the switches within easy reach of a user of the wheelchair 13 or other vehicle. Wires 76 from each respective switch are routed underneath the arm rest 74 of the wheelchair 13 back to the housing 14. The motor switch 72 is connected to the motor so that in a first position the switch 72 will cause the motor 41 to rotate so that the extendable member 12 is raised and in a second position the switch will rotate the motor 41 in the opposite direction to lower the extendable member 12. When the switch 72 is in the first position to raise the extendable member 12, the circuitry controlling the motor 41 will cause the motor 41 to stop when the extendable member 12 has been fully extended. Similarly, the motor 41 will stop when the switch 72 is in the second position and the extendable member has been fully retracted. The light switch 70 is used to turn the light 58 on or off. An additional embodiment, which is not shown, can incorporate the light switch into the same switch that is used to extend or retract the extendable member 12 so that when the extendable member 12 is raised, the light is turned on, and when the extendable member is fully lowered, the light 58 is off. It may also be desirable to have the wires 76 connected to the housing 14 via a removable plug. In such a configuration a duplicate set of switches 70, 72 will be included on the housing 14 so that the light 58 may be controlled when the wires 76 are unplugged. Additionally, the switches 70, 72 may be remotely located and communicate wirelessly to electronics contained within the housing 14 to control the extendable member 12 and light 58.

When a user of the wheelchair 13 or other vehicle wishes to enter a street, he will use the warning lamp 10 to make himself more visible. Before entering the street, the user will turn on the light 58 and extend the extendable member 12 using the switches 70, 72. The light 58 will be bright enough that motorists approaching the vehicle connected to the light will be able to see it better than they would in the absence of the light 58. This is particularly useful at night when seeing a wheelchair 13 in time to avoid a collision might be nearly impossible. As such, the warning lamp 10 will dramatically reduce the likelihood of a car striking a person in a wheelchair 13. The addition of the optional flag 59 will increase visibility when ambient light might reduce the visibility of the light 58. Due to the attachment configuration of the flag 59 that is shown in FIG. 9 the user of the warning lamp 10 will not have to take any extra steps to used the flag 59 because it will unfold as the extendable member 12 raises.

When the user of the wheelchair 13 wishes to enter a building or other areas where having the light 58 protruding would be inconvenient or distracting, the user would then retract the extendable member 12.

The invention is not limited to the details given above but may be modified within the scope of the following claims.

What is claimed is:

1. An extendable vehicle lamp comprising:

a housing mounted to a vehicle;

a multi-axis swivel connected between said housing and said vehicle, said multi-axis swivel rotatable about three axes so that said housing may be rotated in three axes relative to said vehicle;

an extendable member extending from said housing, said extendable member having a first retracted position and a second extended position said extendable member being movable between said first and second position;

a motor contained within said housing, said motor connected to said extendable member for moving said extendable member between said first retracted position and said second extended position;

a light mounted near a distal end of said extendable member;

an electrical conductor longitudinally disposed with said extendable member, said electrical conductor being electrically connected to said light and electrically connected to a power source; and a switch selectively connecting said motor to said power source causing said motor to operate so that said motor may extend or retract said extendable member.

2. An extendable vehicle lamp as claimed in claim 1, wherein said switch is also electrically connected to said electrical conductor and said switch is electrically connected to said power source so that when said switch is switched to operate said motor to extend said extendable member, said light will be electrically connected to said power source thereby lighting said light when said switch is switched to extend said extendable member.

3. An extendable vehicle lamp as claimed in claim 1, wherein said extendable member is comprised of telescoping members coaxially aligned in a sliding relationship.

4. An extendable vehicle lamp as claimed in claim 3, wherein said extendable member is hollow defining a passage which contains said electrical conductor.

5. An extendable vehicle lamp as claimed in claim 4, wherein said multi-axis swivel contains a hinged portion.

6. An extendable vehicle lamp as claimed in claim 1, wherein a secondary signaling device that increases visibility is affixed near the distal end of said extendable member.

7. An extendable vehicle lamp as claimed in claim 6, wherein said secondary signaling device is a flag.

8. An extendable vehicle lamp comprising:

a housing mounted to a vehicle;

a multi-axis swivel connected between said housing and said vehicle, said multi-axis swivel rotatable about three axes so that said housing may be rotated in three axes relative to said vehicle;

an extendable member extending from said housing, said extendable member having a first retracted position and a second extended position movable between said first and second position;

a motor contained within said housing, said motor connected to said extendable member for moving said extendable member between said first retracted position and said second extended position;

a light mounted near a distal end of said extendable member;

an electrical conductor electrically connected to said light and electrically connected to a power source; and a switch selectively connecting said motor to said power source causing said motor to operate so that said motor may extend or retract said extendable member.

9. An extendable vehicle lamp as claimed in claim 8, wherein said extendable member is comprised of telescoping members coaxially aligned in a sliding relationship.

10. An extendable vehicle lamp as claimed in claim 9, wherein said multi-axis swivel contains a hinged portion.

11. An extendable vehicle lamp as claimed in claim 8, wherein a secondary signaling device that increases visibility is affixed near the distal end of said extendable member.

12. An extendable vehicle lamp as claimed in claim 11, wherein said secondary signaling device is a flag.

* * * * *